US006283610B1

(12) United States Patent
Alajajian

(10) Patent No.: US 6,283,610 B1
(45) Date of Patent: Sep. 4, 2001

(54) FLASHLIGHT WITH ROTATABLE HEAD AND THREADED CONNECTION MECHANISM

(76) Inventor: Philip M. Alajajian, 336 Wellman Ave., N. Chelmsford, MA (US) 01863

( * ) Notice: Subject to any disclaimer, the term of this patent is extended or adjusted under 35 U.S.C. 154(b) by 0 days.

(21) Appl. No.: 09/543,872

(22) Filed: Apr. 6, 2000

Related U.S. Application Data

(60) Provisional application No. 60/128,090, filed on Apr. 7, 1999.

(51) Int. Cl.[7] ..... F21L 4/04
(52) U.S. Cl. ..... 362/199; 362/102; 362/109
(58) Field of Search ..... 362/199, 202, 362/204, 205, 102, 109

(56) References Cited

U.S. PATENT DOCUMENTS 5,567,115 * 10/1996 Carbone ..... 362/198
6,012,824 * 1/2000 Sharrah et al. ..... 362/199

* cited by examiner

*Primary Examiner*—Sandra O'Shea
*Assistant Examiner*—John Anthony Ward
(74) *Attorney, Agent, or Firm*—Mark P. White

(57) ABSTRACT

A flashlight design with a rotatable head which operates about an inclined pivot axis such that the light beam may be pointed either in alignment with, or over a range up to a right angle with respect to the base of the flashlight. The flashlight uses one or more battery cells. It includes an electrical sliding commutator mechanism for electrically connecting the bulb to the battery independent of the rotated position of the rotatable head relative to the base. The flashlight also contains a threaded fitting at the end of the base to allow physical interconnection and integration with other products that would benefit by being connected with a maneuverable light source. Such products include, but are not limited to, umbrellas golf bags, and carpentry tools.

16 Claims, 6 Drawing Sheets

FLASHLIGHT WITH ROTATABLE HEAD AND THREADED CONNECTION MECHANISM

PROSECUTION HISTORY

This application claims priority based on Provisional Patent Application Ser. No.: 60/128,090, filed on Apr. 7, 1999.

BACKGROUND OF THE INVENTION

1. Field of the Invention

This invention relates to flashlights, and more specifically to the field of flashlights with rotatable heads. Such designs contain a pivotal connection that permits the light beam to be pointed either straight ahead or at right angles with respect to the base of the flashlight. In addition to having a rotatable head, this flashlight design also contains a threaded connection mechanism to allow for its integration with other products that would benefit by being inter-connected with a maneuverable light source. The primary benefits of this design are the lighting versatility and flexibility afforded by the rotatable head, as well as its utility in providing illumination for any products that it can be connected with. Such products may include umbrellas, golf bags, and carpentry tools, to name a few.

2. Background and Description of Prior Art

In the prior art, flashlights with rotatable heads have been designed primarily to provide greater lighting flexibility to the user. Some of the earliest of these designs include U.S. Pat. Nos. 1,832,564 of Kuehn. and 2.259,673 of White. Both designs teach how a rotatable head may be constructed by having a flashlight head rotating in a plane oriented at an acute angle typically 45 degrees, to the longitudinal axis of the base. Such structures permit the beam of light projected by the illuminated bulb to be projected along a path ranging from being parallel to the axis of the flashlight base to being perpendicular with respect to it. More recent designs for such flashlights include those of U.S. Pat. Nos. 5,278,739 and 5,161,095 of Gammache. The patents of Gammache emphasize the alignment of the pivotal axis with the filament of the bulb, such that the filament remains fixed on the pivotal axis irrespective of the rotated position of the head. No such alignment is provided for nor claimed in the design to be described. The prior art for flashlights with rotatable heads has not yet produced a flashlight that employs battery cells positioned side-by-side, nor one that can be attached to an umbrella or with other products by means of a threaded metal insert. Such a flashlight will provide lighting versatility and flexibility by means of the rotatable head, as well as enhanced utility Linder poor lighting conditions for any products that it can be connected with by means of the threaded metal insert. Combining the use of a rotatable flashlight head with a fixed base also poses problems associated with the mounting of the head to the base and with the electrical connection of the flashlight bulb to the batteries from which they are powered. This provides further opportunity for improvement to the field of such flashlights.

SUMMARY OF THE INVENTION

It is the object of the subject invention concept to provide a flashlight, including a head and a base, with a maneuverable beam for a wide range of products with which it may be inter-connected. In particular, it is an object of this invention to provide a terminal mechanism for a flashlight with a head rotatable with respect to the base, that will maintain electrical contact with the light bulb while the bulb is rotated with the head from one rotated position to another, while the base remains fixed. It is an advantage of this invention to provide a flashlight with a rotatable head that employs two or more batteries arranged in a side by side configuration within a battery casing to minimize the length of the casing, by electrically connecting with the rotatable head by means of a skillfully engineered neck handle, and flashlight head.

It is another object of this invention to provide a flashlight with a rotatable head containing a threaded connection mechanism to enable it to be easily joined with an umbrella handle shaft, either temporarily or permanently.

It is a further object of this invention to provide a flashlight with a rotatable head that enables batteries to be loaded at a point between the neck and the handle casing to enable other products to be joined and inter-connected at the rear end of the handle casing.

It is a still further object of this invention to provide a flashlight with a rotatable head and threaded connection mechanism that is durable in construction, water-resistant, economical to manufacture, care-free to maintain easy to assemble, and effective and simple to use.

In accordance with one aspect of the invention a flashlight with a rotatable head includes a base, which further includes a power source. The flashlight also includes a neck, having a base end and a head end, removeably attached to the base at the base end the head, having a neck end and a light end, rotatably attached at the neck end to the neck, and further including a light source at the light end, and a rotatable electrical connection between the power source and the light source. As the head is rotated relative to the base, the aforementioned connections maintain electrical continuity between the power source and the light source.

According to a second aspect of the invention, a flashlight with a rotatable head includes a fixed part, which further includes a power source. The head has a fixed end and a light end. The head is rotatably attached at the fixed end to the fixed part, and further includes a light source at the light end. The flashlight also contains a means to maintain electrical connectivity between the power source and the light source as the head is rotated relative to the fixed part.

According to a third aspect of the invention, the fixed part further includes: a base, which contains the power source, a neck, removeably attached to the base, and an electrical connection between the base and a neck. The means to maintain electrical connectivity between the power source and the light source further includes a rotatatable electrical connection between the neck and the head. As a result, the neck, when attached to the base, remains fixed with respect to the base, the head rotating relative to the neck and the electrical connection between the power source and the light source remaining, in effect as the head is rotated.

According to a fourth aspect of the invention, the rotatable electrical connection between the head and the neck includes a sliding commutator.

According to a fifth aspect of the invention, the electrical connection includes a positive circuit and a negative circuit and the sliding commutator further includes a positive commutator which provides continuity for the positive circuit, and a negative commutator, which provides continuity for the negative circuit.

According to a sixth aspect of the invention, a switch located in the base is also included, the switch having an on position and an of position the on position connecting the positive and negative circuit to the power source, and the off position disconnecting the positive and negative circuit from the power source.

According to a seventh aspect of the invention, both the neck and the head are in the form of a cylinder having a major axis, with a base at one end perpendicular to the major axis, and the cylinder intersected at the other end by a plane at approximately 45 degrees to the major axis. The light source is located in the cylinder base end of the head, and the neck is attached at the cylinder base end to the base, so that the major axis of the head may be rotated at an angle between 90 degrees and zero degrees relative to the major axis of the base.

According to an eighth aspect of the invention, the power source includes one or more batteries.

According to a ninth aspect of the invention, the light source further includes a bulb, and the commutator further includes a metal pivot pin, an annular metal ring; and a metal strip, so that the bulb remains in electrical contact with the metal pin and by means of a metal strip as the head is rotated and wherein the bulb remains in contact with the annular metal ring by means of a metal strip when the head is rotated.

According to a tenth aspect of the invention, the body has a neck end and a utility end, and it further includes a threaded connector located in the utility end of the body, so that threaded objects are attached to the body.

According to a final aspect of the invention, the threaded objects consist of members of the group including umbrellas, golf bags, and carpentry tools.

BRIEF DESCRIPTION OF THE DRAWINGS

These, and further features of the invention, may be better understood with reference to the accompanying specification and drawings depicting the preferred embodiment, in which.

DETAILED DESCRIPTION OF THE PREFERRED EMBODIMENT

Figure 6:
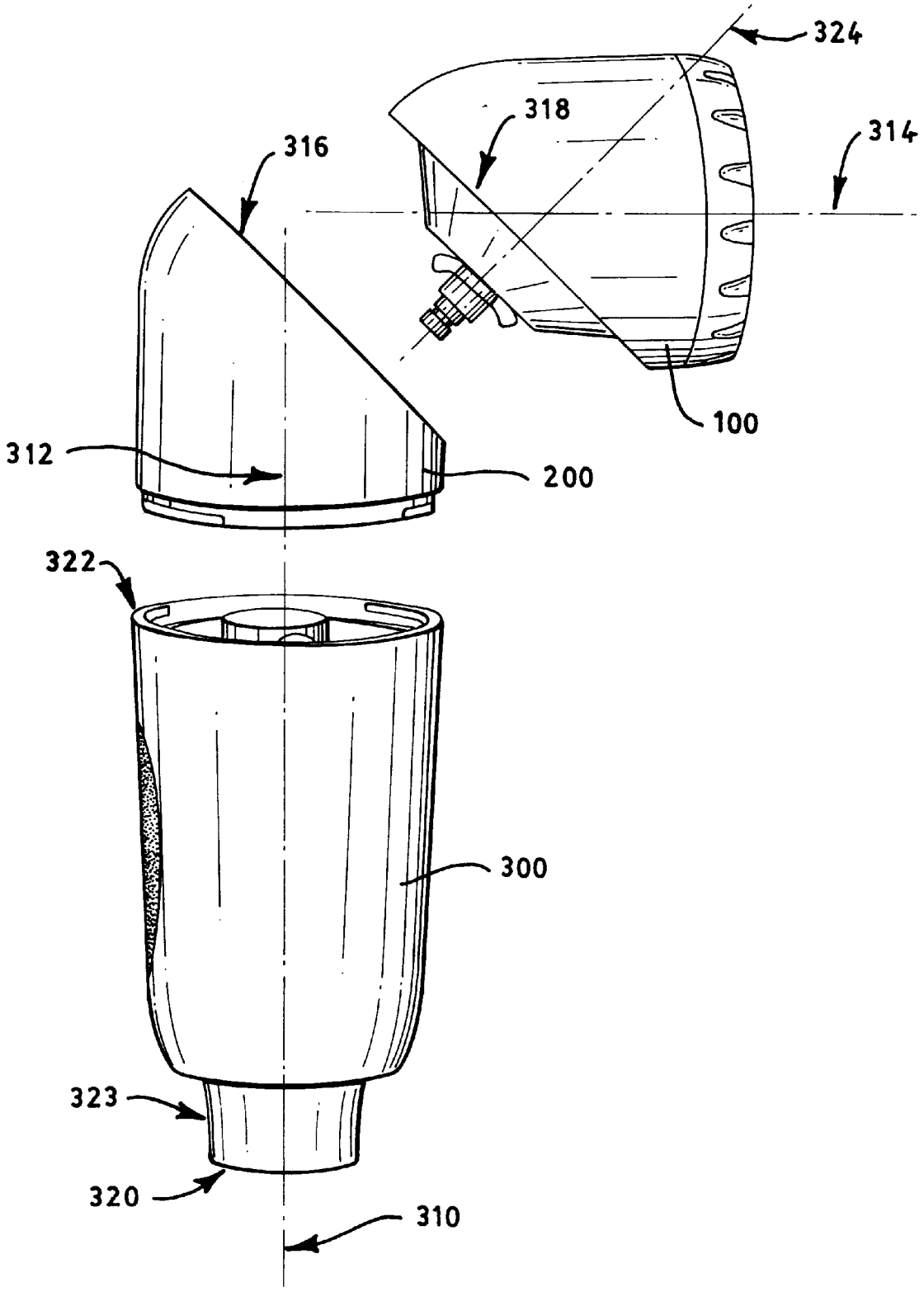
FIG. 6 is a perspective view of the flashlight showing the major axis of the head aligned with the major axis of the handle.

The objects, features and advantages are accomplished according to the invention herein described by providing a device consisting of five major components: a rotatable flashlight head, a neck, a handle casing, a battery holder, and a threaded interconnection mechanism. Each of these components can be created by plastic injection molding, including the threaded interconnection mechanism. The handle, neck and head may be made up of a translucent plastic resin to permit the user to view the condition of the internal components. Further, as shown in FIG. 6, the handle and neck may be tapered in a conical fashion for enhancement of a human grip. This is in contrast with the alternative implementation of FIG. 1, in which the handle and neck are both perfectly cylindrical. In the preferred embodiment, for durability of the interconnection mechanism, a threaded die-cast metal component is insert-molded into the base of the handle casing. The rotatable flashlight 'head' is the maneuverable upper component of the flashlight that is integrated with a non-rotating lower component or 'neck'. The head houses a lamp system comprising a parabolic reflector, flashlight bulb and lens. It also contains a threaded lens cover to permit easy bulb replacement. The bulb is electrically connected to the battery source by means of electrical commutators. These include a fixed metal pivot pin (constituting the positive terminal), metal contacts, and dual annular metal rings with attached metal strips (constituting the negative terminal) which face each other on the mating edges of the neck and head, respectively. The pivot pin, and dual annular metal rings with attached metal strip together with other metal contacts maintain electrical contact throughout the range of rotated positions of the head. The pivot axis comprises a metal pivot pin with a flat circular top; the circular top being of wider diameter than the concentric holes on the mating edges of the head and neck. The metal pivot pin is inserted through the plastic head at the center of its diagonal base. It mechanically joins the head to the neck. The fiat circular top of the metal pivot pin seats within the head. The pin passes through the neck and is held in place by a lock washer in the neck. The lock washer is too large to pass through the hole in the neck, thereby attaching the head to the neck and allowing for its free rotation. The upper end of the neck 'threads' onto the lower end of the handle casing with a quarter-turn locking mechanism. A plastic battery holder mechanically holds the batteries in place. This battery holder seats within the handle casing. When the handle casing is threaded onto the neck, the lower terminals of the batteries seated within the battery holder align with the metal contacts inside the neck. These contacts pass current to the head via the pivot pin and via the dual annular metal rings with attached metal strips associated with the neck and head, respectively.

The battery holder accommodates at least two "AA"; size, 1.5 volt batteries which are internally wired together in "series"; fashion. The use of "AA" cells helps to minimize the weight of the handle, while still achieving reasonable battery life. The inside top of the handle casing contains two metal contact strips located along one side that contacts each of the batteries. A series connection with the batteries is electrically established or disconnected by means of a slide switch within the handle casing. The slide switch comprises a metal spring contact that is configured so that when the slide switch is moved into the position towards the bulb, an electrical connection is established between the two metal battery contact strips located along the side of the battery holder. The interconnection mechanism is a threaded metal component that is insert-molded into the base of the plastic handle casino to permit a mechanical connection to be made with other products and in particular, an umbrella.

Figure 1:
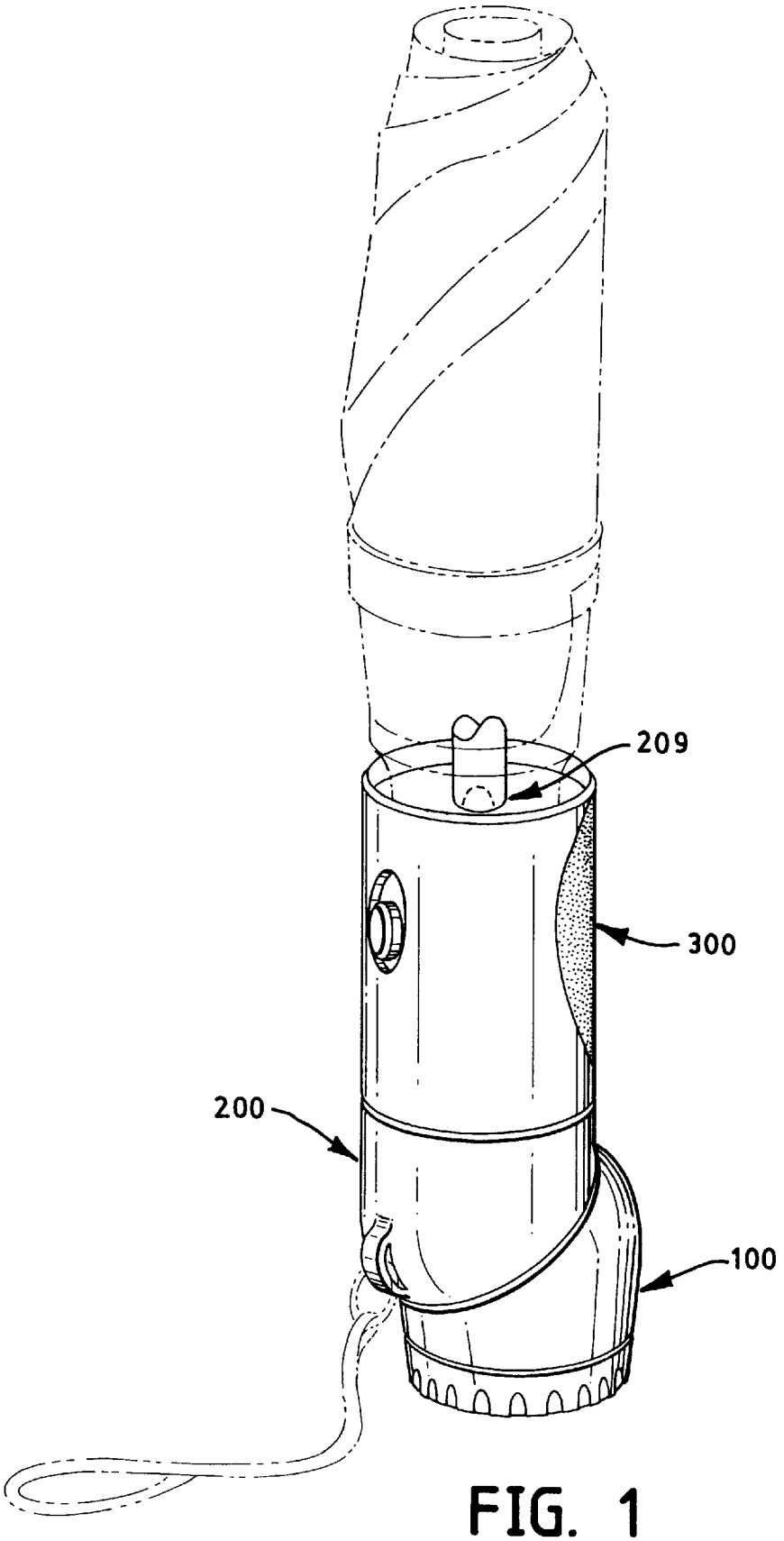
FIG. 1 is a perspective view of the major components of the flashlight with rotatable head and threaded interconnection mechanism of this invention, showing an umbrella connected to the free end of the handle.
Figure 2:
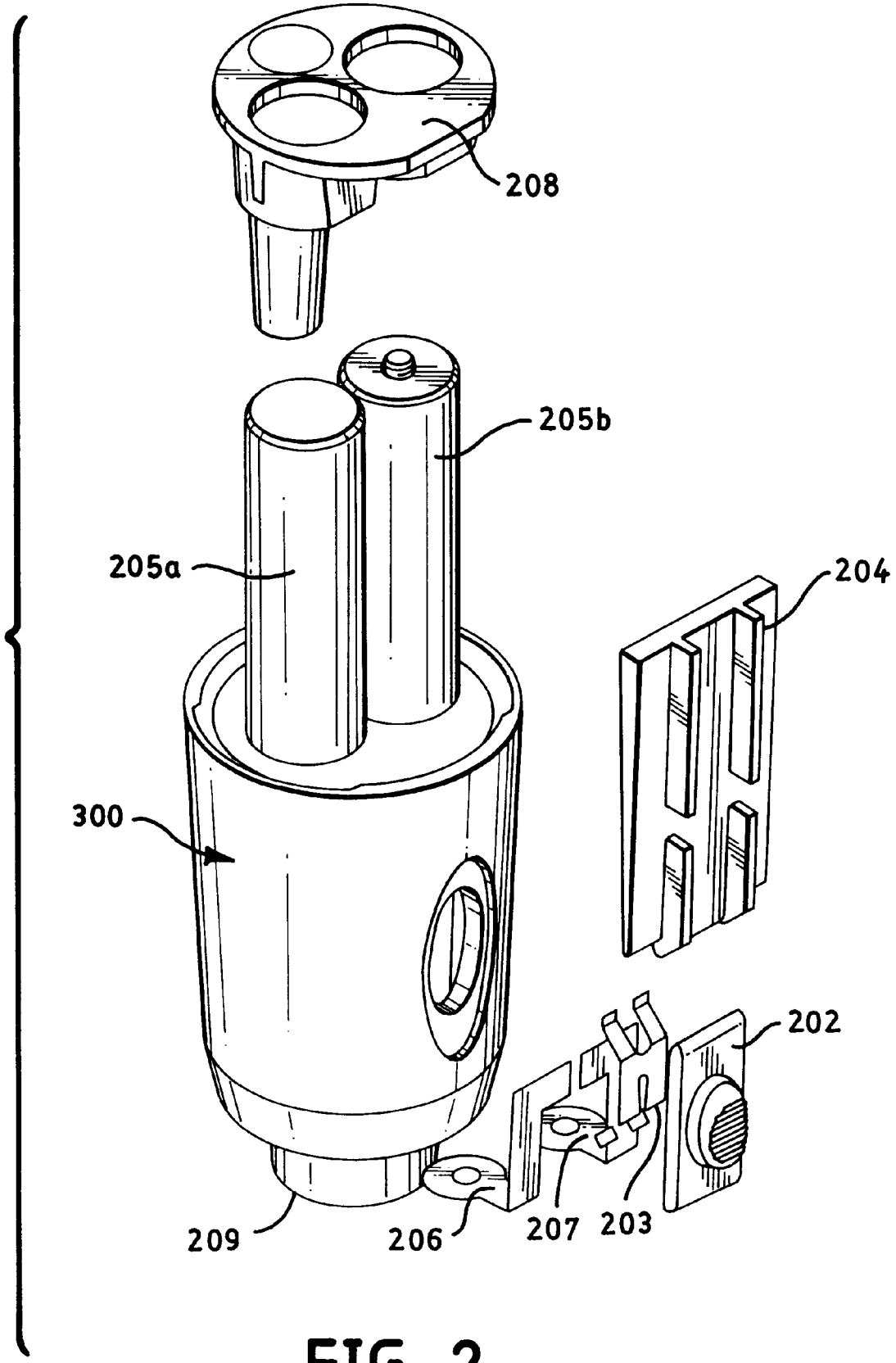
FIG. 2 is an exploded view of the handle of the flashlight with rotatable head and threaded interconnection mechanism of this invention.

Referring now to FIG. 1, the flashlight with rotatable-head consists of three major components; a rotatable flashlight head [100], a neck [200], a handle casing [300]. The handle casing contains three major sub-components: a battery holder [208], a slide switch [202, 204] and a threaded interconnection mechanism [209], as shown in FIG. 2. The housing for each of these components can be created by plastic injection molding. In the preferred embodiment, the threaded interconnection mechanism is a threaded die cast metal component that is insert-molded into the base of the handle for enhanced durability and life.

Referring to FIG. 6, it is seen that all three major components are forms of cylinders. The base or handle [300] of the flashlight has a major axis [310], which is perpendicular to both the top [320] and bottom ends [322]. The neck [200] has its top end [316] formed by the intersection of a plane at approximately 45 degrees to the major axis [312]. The head likewise has one end [318] formed by the intersection of a plane at approximately 45 degrees to the major axis [314].

When the head is rotated, it rotates not about its major axis, but about an axis normal to the 45-degree-inclined end [318]. As a result, rotation about this second axis will incline the head from the position shown in FIG. 6, which is 90 degrees from the handle, to the position shown in FIG. 1, which is 180 degrees, or in line with the handle.

DETAILED DESCRIPTION

Figure 3:
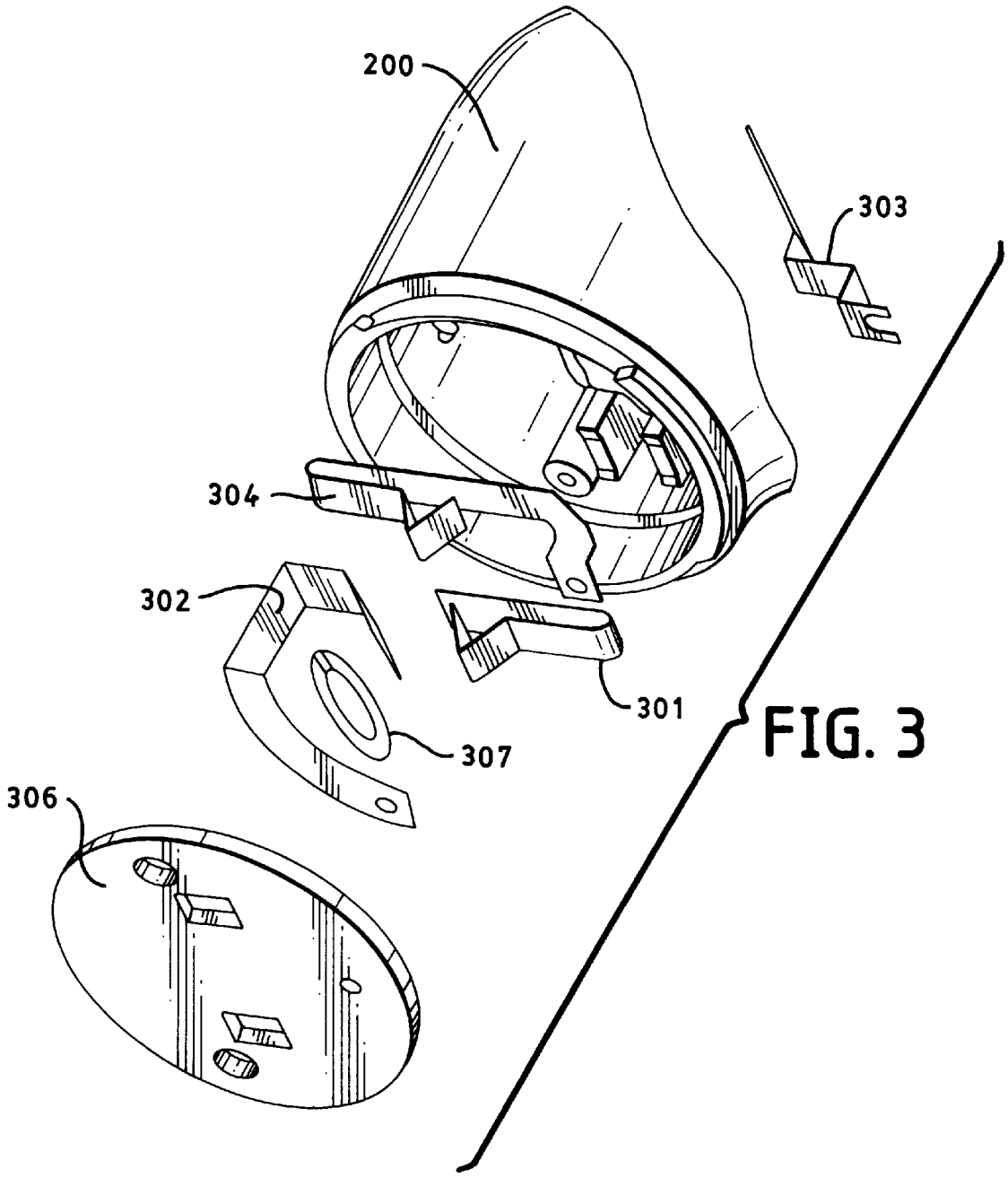
FIG. 3 is an exploded view of the neck of the flashlight with rotatable head and threaded interconnection mechanism of this invention.
Figure 4:
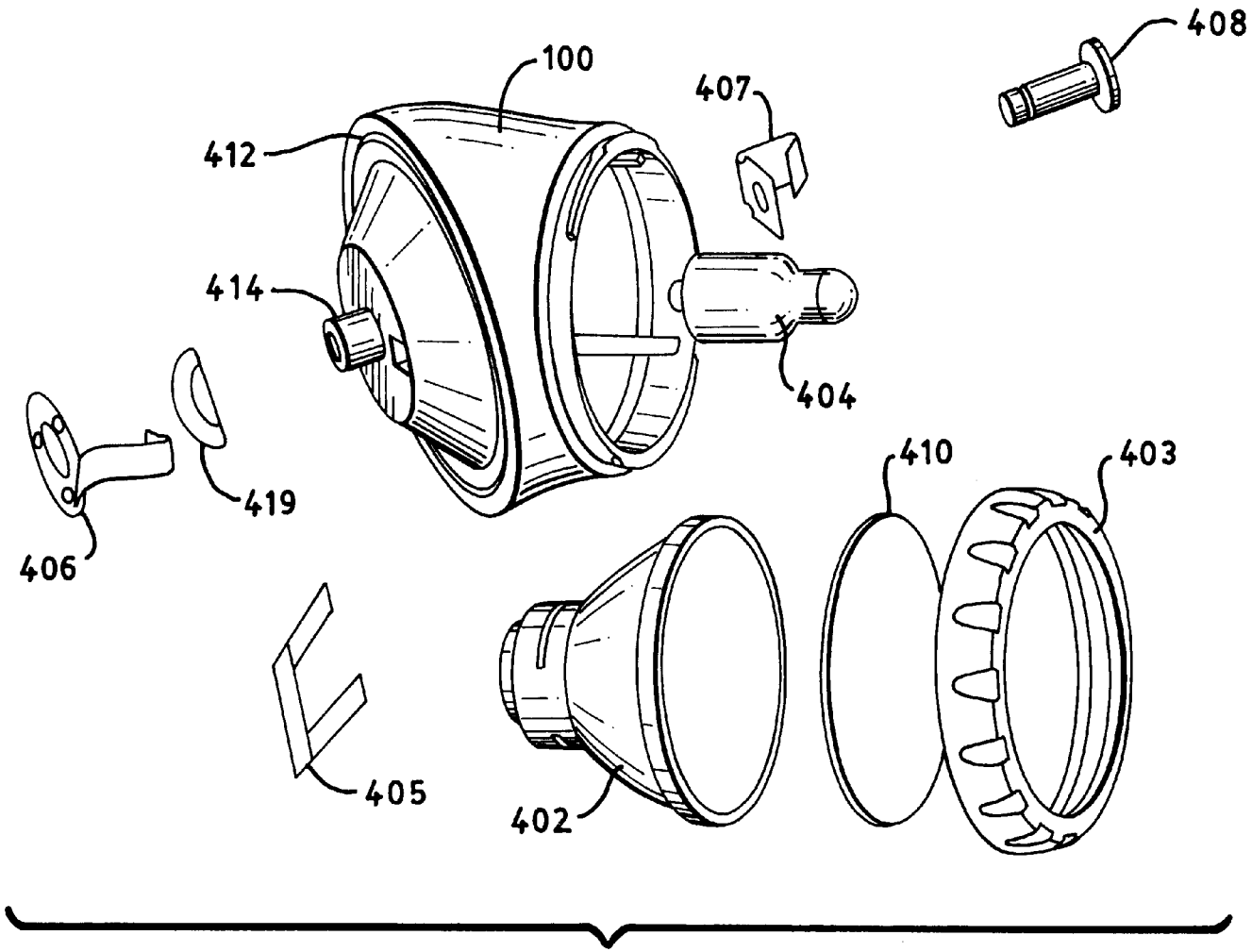
FIG. 4 is an exploded view of the head of the flashlight with rotatable head and threaded interconnection mechanism of this invention.
Figure 5:
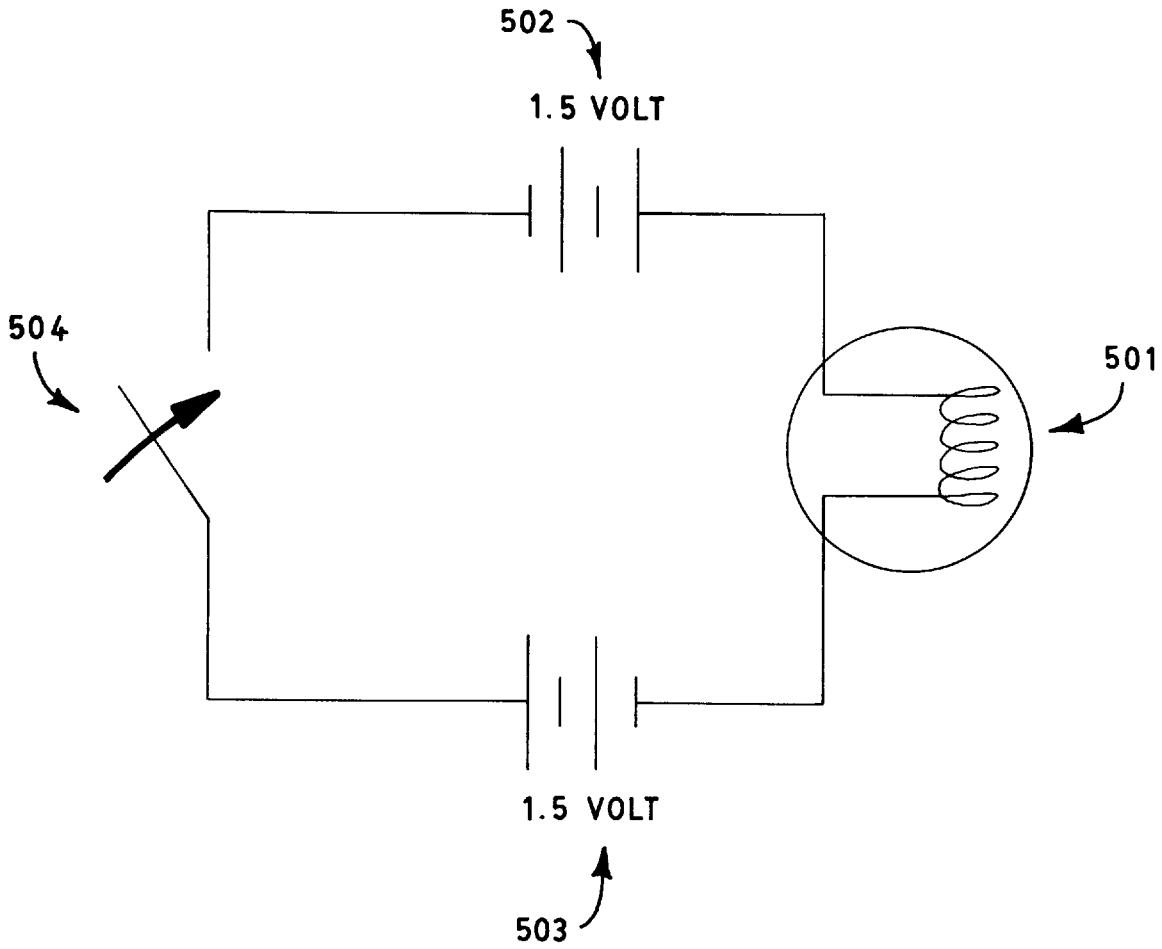
FIG. 5 is a circuit diagram for the electrical system of the flashlight with rotatable head and threaded interconnection mechanism of this invention.

The flashlight with rotatable head depicted in FIG. 1 consists of several major components, including a rotatable flashlight head or 'head' [100], affixed together by means of a metal pivot pin with a flat circular top to a 'neck' [200], which itself threads onto the open end of the handle casing [300] with a quarter-turn lock mechanism. The head assembly shown in FIG. 4 contains a lamp system comprising a reflector [402], a flashlight bulb [404], and a lens [410], and a metal pivot pin with a flat circular top [408]. A threaded lens cover [403] is also contained in the head assembly for easy bulb replacement. An O-ring is seated into the circular cavity [412] along the mating surface of the head with the neck for enhanced water resistance. The flashlight handle shown in FIG. 2 contains an integrated handle casing [300], a battery holder [208], a plastic slide switch [202, 204], with metal contacts [203, 206, 207] and an inter-connection mechanism, or 'threaded metal insert' [209] for connecting with an external product such as an umbrella. The electrical circuit diagram is depicted in FIG. 5. The metal components comprising the wiring system, aside from the switch itself are located in the neck and head as shown in FIGS. 3 and 4 respectively. These employ positive metal components [301, 302] [407, 408] and negative metal components [303, 304] [405, 406]. Each of these components is described in greater detail in the following sub-sections.

Rotatable Flashlight Head and Neck

The rotatable flashlight head is located at one end of the flashlight and is joined to and derives power from the neck by means of an electromechanical connecting mechanism described as follows. Referring to figure 1, the lower end of the molded plastic neck [200] attaches to the open end of the molded plastic handle [300] through a quarter-turn locking mechanism allowing easy access for changing the batteries. The rotatable flashlight head [100] is affixed to the neck [200] along a pivot axis by a metal pivot pin with a flat circular top [408] as shown in FIG. 4. An O-ring is seated into the circular cavity [412] along the mating surface of the head with the neck for enhanced water resistance. Also shown in FIG. 4 is the head [100] containing a lamp system. The lamp systemic contains a chrome-plated parabolic reflector [402], a flashlight bulb [404], and a flashlight lens [410] to focus the light from the parabolic reflector. The head also contains a threaded lens cover [403] to allow access to the lamp system for easy bulb replacement. The ground casing of the bulb is electrically attached to a metal collar [405] that also serves to hold the bulb in place. The metal collar makes electrical contact with a negative metal strip with annular ring [406] located on the mating surface of the head [100], forming an electrical commutator mechanism. The projection of the negative metal strip with annular metal ring passes through a slot in the mating surface of the plastic head to allow contact with the metal collar [405] and with the annular metal ring [303] located on the lower mating surface of the neck [200]. The negative metal strip with annular metal ring [406] located within the head contains two or more raised contact points which make electrical contact with the annular metal ring of the neck [303] by brushing up against it for an entire 360 degree range of rotation. The negative metal strip with annular metal ring [406] is held in place by a frictional fit of the ring to the plastic projection [414] of the central axis of the head, and by virtue of its position of being sandwiched between the head and the neck. A metal spring washer [409] is positioned between the annular metal ring [406] and the inner surface of the head [100] to provide smoother head rotation. The O-ring seated in the circular cavity [412] of the head also enhances the rotational friction and ensures smoother head rotation, in addition to enhancing water resistance in the gap between the head and neck. The negative metal terminal [304] establishing the negative battery contact is attached within the neck by means of a metal screw. A tab projection on the negative annular metal ring [303] associated with the neck passes through a slot in the plastic neck enabling it to connect with the negative metal terminal [304] to establish the negative battery contact. This arrangement forms the negative side of the electrical connection to the bulb in the neck.

The rotatable head [100] connects mechanically to the neck [200] by means of a metal pivot pin with a flat circular top [408] which extends through the head and into the neck via the centrally located holes at the mating surfaces of the head and neck. The pin is held in place and attached to the neck by means of a lock washer [307] from within the neck, the pin is electrically insulated from the negative annular metal ring contact [406] by the internal plastic projection [414] of the central axis of the plastic head itself [100]. The metal pivot pin with a flat circular top [408] also passes through a hole in a positive contact strip [407]. The tip of the bulb [404] makes contact with the positive contact strip [407]. A second positive metal strip [302] also containing a hole is attached to the pivot pin within the neck by being installed over the pin beneath the lock washer [307]. This second positive metal strip is attached to another metal strip [301] which is attached to the neck by means of a metal screw. This metal strip [301] establishes the positive battery contact and makes contact with the with the positive battery terminal [205*b*] when the handle is threaded onto the neck. This arrangement forms the positive side of the electrical connection to the bulb in the neck.

The positive and negative connections to the bulb established in the rotatable head and transferred to the neck in the manner described are connected to the battery source through two sets of metal strips within the neck. These sets are the positive terminal strips [301, 302] and the negative terminal strips [303, 304], both of which are located within the neck. Each set could be combined into a single strip but these are kept distinct for greater ease of assembly. The positive terminal strip [302] is designed to connect electrically with the metal pivot pin held in place via the lock washer [307] without interfering with the rotation of the pin. The positive metal strip [301] makes contact with the positive battery terminal [205*b*], while the negative metal strip [304] makes contact with the negative battery terminal [205*a*], respectively, located at the base of the battery holder, when the handle casing is threaded onto the neck.

Handle Casing The handle casing [300], as shown in FIG. 2, contains the battery/switch components of the flashlight. The handle casing accommodates two "AA", size, 1.5 volt batteries [205*a*, 205*b*] which are internally wired together in "series" fashion by means of metal contact strips [206, 207]. This provides the necessary 3.0 volt battery pack required to power the bulb. The use of "AA" cells helps to minimize the weight of the handle while still achieving reasonable battery life. Referring to FIG. 2, the switch comprises two metal contact strips a positive strip [206]] and a negative strip [207] which are integrated within the plastic switch support [204] in the upper section of the handle housing [300]. These strips make contact with each of the batteries [205*a*, 205*b*] when both are permanently installed in the handle. The strips are connected together electrically by means of the metal spring contact comprising the slide switch [203]. When the plastic slide switch button [202] is in a lowered position, towards the bulb, its associated metal spring contact [203] is lowered thereby electrically connecting these positive and negative strips. When in a raised positions the slide switch button breaks the connection by allowing its metal spring contact to be lifted. A plastic holder [1208] located at the base of the handle casing retains the batteries securely in place. When the handle casing is quarter-turn locked onto the neck the positive and negative terminal of each battery located at the base of the battery holder align with the positive terminal [301] and negative terminal [304] seated within the neck [200] which establishes electrical contact with the bulb. These terminals within the neck are comprised of metal spring contacts.

Slide Switch

Referring to FIG. 2, a slide switch button [202] is located on the middle back-side of the handle casing [300] of the flashlight. The slide switch is comprised of a switch button [202], a plastic support/retainer [204] and a metal spring contact [203]. When moved in a position towards the bulb, the metal spring contact comprising the switch is pressed against both the positive and negative metal contact strips [206, 207] of the plastic support/retainer completing the series circuit joining the batteries [205*a*, 205*b*] seated within the battery holder [208]. This action in turn illuminates the bulb. When the switch is moved away from the bulb, the metal spring contact [203] comprising the switch is lifted, thereby breaking the electrical connection of the batteries, deactivating the bulb.

Wiring of Batteries

The circuit diagram for the electrical system of the flashlight is shown in FIG. 5. The circuit consists of a single bulb [501] wired in series to a power supply [502, 503] by means of a single pole-single throw switch [504]. The handle contains all necessary wiring for the lamp system as shown in FIGS. 2. 3 and 4 and described in previous sections.

Interconnection Mechanism

Referring to FIG. 2, the interconnection mechanism consists of a threaded metal insert [209] that is insert molded within the utility end of the handle casing.

The utility end may contain a tapered nipple projection [323] as shown in FIG. 6 to enhance the ability of the user to grip the handle with the interconnected object. The tapered nipple projection may contain an insert-molded threaded metal insert, or may have its own internal plastic threads resulting from the injection molding process. This is in contrast with the embodiment depicted in FIG. 1, in which the tapered nipple projection is noticeably absent. Instead, in FIG. 1, the metal insert is seated within the top portion of the cylindrical handle casing, or the threads are molded into the plastic handle casing via the injection molding process.

It will be apparent that improvements and modifications may be made within the purview of the invention without departing from the scope of the invention defined in the appended claims.

What is claimed is:

1. A flashlight with a rotatable head, comprising:

a base, which further comprises a power source;

a neck, having a base end and a head end, removeably attached to the base at the base end;

the head, having a neck end and a light end, rotatably attached at the neck end to the neck, and further comprising a light source at the light end; and a rotatable electrical connection between the power source and the light source, said connections maintaining electrical continuity between the power source and the light source as the head is rotated relative to the base.

2. A flashlight with a rotatable head, comprising:

a fixed part, which further comprises a power source;

the head, having a fixed end and a light end, rotatably attached at the fixed end to the fixed part, and further comprising a light source at the light end; and means to maintain electrical connectivity between the power source and the light source as the head is rotated relative to the fixed part.

3. The flashlight of claim 2, wherein the fixed part further comprises:

a base, which contains said power source;

a neck, removeably attached to the base; and an electrical connection between the base and a neck, and wherein the means to maintain electrical connectivity between the power source and the light source further comprises a rotatatable electrical connection between the neck and the head, so that the neck, when attached to the base, remains fixed with respect to the base, the head rotating relative to the neck, and the electrical connection between the power source and the light source remaining in effect as the head is rotated.

4. The flashlight of claim 3, wherein the rotatable electrical connection between the head and the neck comprises a sliding commutator.

5. The flashlight of claim 4, wherein the electrical connection comprises a positive circuit and a negative circuit, and the sliding commutator further comprising a positive commutator which provides continuity for the positive circuit, and a negative commutator, which provides continuity for the negative circuit.

6. The flashlight of claim 5, further comprising a switch located in the base, the switch having an on position and an off position, the on position connecting the positive and negative circuit to said power source, and the off position disconnecting the positive and negative circuit from said power source.

7. The flashlight of claim 6, wherein both the neck and the head are in the form of a cylinder having a major axis, with a base at one end perpendicular to the major axis, and the cylinder intersected at the other end by a plane at approximately 45 degrees, to said major axis, the light source located in the cylinder base end of the head, and the neck attached at the cylinder base end to the base, so that the major axis of the head may be rotated at an angle between 90 degrees and zero degrees relative to the major axis of the base.

8. The flashlight of claim 7, wherein the power source comprises one or more batteries.

9. The flashlight of claim 8, wherein the light source further comprises a bulb, and the commutator further comprises:

a metal pivot pin;

an annular metal ring; and a metal strip, wherein a terminal of said bulb remains in electrical contact with said metal pin by means of said metal strip as the head is rotated and wherein an alternate terminal of said bulb remains in contact with said annular metal ring by means of a second said metal strip when the head is rotated.

10. The flashlight of claim 9, wherein the body further comprises a neck end and a utility end, and further comprising a threaded connector located in the utility end of the body, so that threaded objects are attached to the body.

11. The flashlight of claim 10, wherein the threaded objects consist of members of the group including umbrellas, golf bags, and carpentry tools.

12. The flashlight of claim 10, wherein said utility end has a tapered nipple projection; and said nipple projection contains a threaded interior.

13. The flashlight of claim 2, wherein the fixed part is tapered in a conical fashion for enhancement of a human hand grip.

14. The flashlight of claim 3, wherein the base, neck and head are comprised of a translucent plastic resin to permit the user to view the condition of the internal components.

15. The flashlight of claim 1 wherein said head contains an O-ring, and further contains a spring on the neck end to enhance rotational friction and to maintain smoother rotation of the head.

16. The flashlight of claim 2, wherein the fixed part further comprises a base, wherein the base further comprises a neck end and a utility end, and wherein said utility end has a tapered nipple projection containing a threaded interior.

* * * * *